US006237374B1

(12) United States Patent
Malchow et al.

(10) Patent No.: US 6,237,374 B1
(45) Date of Patent: May 29, 2001

(54) HIGH PRESSURE CLEANING VESSEL WITH A SPACE SAVING DOOR OPENING/CLOSING APPARATUS

(76) Inventors: Gregory L. Malchow, 1903 Scarlet Oak Trail, Oshkosh, WI (US) 54904; Andrew Kegler, 547 Eureka St., Ripon, WI (US) 54971; Stephen L. Harris, 365 Westbrook Dr., Oshkosh, WI (US) 54904

( * ) Notice: Subject to any disclaimer, the term of this patent is extended or adjusted under 35 U.S.C. 154(b) by 0 days.

(21) Appl. No.: 09/338,590

(22) Filed: Jun. 23, 1999

Related U.S. Application Data

(63) Continuation-in-part of application No. 08/998,294, filed on Dec. 24, 1997, now Pat. No. 6,070,440.

(51) Int. Cl.[7] ..... D06F 43/02; D06F 37/28

(52) U.S. Cl. ..... 68/139; 68/196; 68/210

(58) Field of Search ..... 68/139, 196, 210; 34/596, 601; 134/159, 200; 220/812

(56) References Cited

U.S. PATENT DOCUMENTS 2,639,601 * 5/1953 Miller ..... 68/210 X
3,498,089 * 3/1970 Miller et al. ..... 68/139
4,217,920 * 8/1980 Ballard ..... 134/200 X
4,964,228 * 10/1990 Coffman ..... 34/601 X
5,357,772 * 10/1994 Hendren ..... 68/210

* cited by examiner

*Primary Examiner*—Philip R. Coe
(74) *Attorney, Agent, or Firm*—Leydig, Voit & Mayer, Ltd.

(57) ABSTRACT

A liquified gas dry-cleaning machine having a cleaning vessel with a chamber for containing a wash bath and items to be cleaned and a removable door for sealing the cleaning chamber during a dry-cleaning operation. The dry-cleaning machine has a door opening and closing apparatus which includes a pivot frame for moving the door outwardly from the cleaning vessel in an arced path of movement, and a slide for lowering the door on the pivot frame in a linear path of movement to a position below the level of the cleaning vessel. Reverse movement of the pivot frame thereupon positions the door in a tucked stored position at the same axial location with respect to the cleaning vessel as when the door is closed so as not to impede access to the cleaning chamber nor increase the axial reach of an operator necessary for removing items from the chamber. The door opening and closing apparatus further includes a protective plate which is carried by the pivot frame and is movable between a raised position for protecting operating personnel during door opening and closing operations and a lower position for permitting access to the cleaning chamber following a door opening operation.

27 Claims, 12 Drawing Sheets

71
11
81
95
81
88
76
92
88
89
89
86
94
86
75
75
74
72
70
31
72
60
61
34
60
12
62
84
110
110
84
75
75
12
85
85
99
79
99
79

HIGH PRESSURE CLEANING VESSEL WITH A SPACE SAVING DOOR OPENING/CLOSING APPARATUS

RELATED APPLICATION

This application is a continuation-in part of U.S. application Ser. No. 08/998,394 filed Dec. 24, 1997, and now U.S. Pat. No. 6,070,440.

FIELD OF THE INVENTION

The present invention relates generally to pressurized liquid cleaning systems, and more particularly, to an apparatus for opening and closing an access door to a high pressure cleaning vessel used in such systems.

BACKGROUND OF THE INVENTION

Known dry-cleaning processes consist of a wash, rinse, and drying cycle with solvent recovery. Garments are loaded into a basket in a cleaning drum and immersed in a dry-cleaning fluid or solvent, which is pumped into the cleaning drum from a base tank. Conventional dry-cleaning fluids include perchloroethylene (PCE), petroleum-based or Stoddard solvents, CFC-113, and 1,1,1-trichloroethane, all of which are generally aided by a detergent. The solvent is used to dissolve soluble contaminants, such as oils, and to entrain and wash away insoluble contaminants, such as dirt.

The use of these conventional solvents, however, poses a number of health and safety risks as well as being environmentally hazardous. For example, halogenated solvents are known to be environmentally unfriendly, and at least one of these solvents, PCE, is a suspected carcinogen. Known petroleum-based solvents are flammable and can contribute to the production of smog. Accordingly, dry cleaning systems which utilize dense phase fluids, such as liquid carbon dioxide, as a cleaning medium have been developed. An apparatus and method for employing liquid carbon dioxide as the dry-cleaning solvent is disclosed in U.S. Pat. No. 5,467,492, entitled "Dry-Cleaning Garments Using Liquid Carbon Dioxide Under Agitation As Cleaning Medium". A similar dry cleaning apparatus is also disclosed in U.S. Pat. No. 5,651,276.

These systems pose a number of other problems, particularly in relation to the high operating pressures necessary for maintaining the gas in a liquid state. For example, the various pressurized components of the system must be constructed with thick, heavy walled structures to withstand the elevated pressures encountered during the dry cleaning operation. These bulky structures can consume a significant amount of space. In order to encourage dry cleaning operators to convert to liquid carbon dioxide dry cleaning systems, these new systems must be configured so as to minimize space consumption. This is necessary to enable such systems to be placed into facilities and locations designed for existing dry-cleaning equipment. Moreover, due to the neighborhood nature of many dry cleaning operations, there can be even greater space limitations. Thus, while minimizing space requirements is always an important object, it is particularly important with dry cleaning equipment.

In terms of space consumption, one of the more critical aspects of a liquifiable gas dry-cleaning apparatus is the area required for opening and closing of the access door of the pressurized cleaning vessel to permit loading and removal of garments or other items for cleaning. Since the cleaning vessel in a liquid carbon dioxide system operates at a high pressure (e.g. 700–850 psi) under ambient temperature conditions in order to ensure that the carbon dioxide remains in a liquid phase, a relatively bulky, heavy walled door must be used. One type of door which could be used on such a liquid carbon dioxide cleaning vessel is a conventional hinged door. Due to the weight of the door, an opening mechanism typically would have to be provided for swinging the door to an open position at the side of the cleaning vessel. However, with such a hinged door a significant amount of clearance would have to be provided both in front of the cleaning vessel, to allow for the swinging motion of the door, and to at least one side of the cleaning vessel. Moreover, additional space would have to be provided for the door opening and closing mechanism.

While the need to minimize space consumption in the front of the cleaning vessel might be satisfied by using a door which could slide horizontally into an open position, clearance again would have to be provided on at least one side of the cleaning vessel to allow for the open door. Additionally, the mechanism for horizontally sliding the door to the open position would have to be arranged to the side of the cleaning vessel and likely would require additional space.

Not only does the bulk and size of the removable door and its opening mechanism consume floor space, they further may impede access to the cleaning chamber when the door is opened. Moreover, if any part of the door or its opening mechanism is moved to a position in front of the cleaning vessel as a result of the door opening operation, it can extend the axial reach necessary for an operator to manually reach into the cleaning chamber to load or unload items therein.

OBJECTS AND SUMMARY OF THE INVENTION

Accordingly, it is an object of the invention to overcome the problems associated with the use of conventional doors and door opening mechanisms on high pressure cleaning vessels for liquified gas dry-cleaning systems.

A more specific object of the invention is to provide an apparatus for opening and closing a door to a high pressure liquified gas cleaning vessel which requires minimal clearance space for operation.

Another object of the present invention is to provide a door opening apparatus as characterized above which occupies a minimal amount of space in both the open and closed positions and in which the door always remains entirely within the lateral confines of the cleaning vessel.

A further object is to provide an apparatus of the foregoing type in which neither the door nor its opening mechanism increases the axial reach required for an operator to manually reach into the cleaning chamber when the door is in an open position.

Yet another object is to provide an apparatus of the above kind in which the door assumes a common axial position with respect to the cleaning vessel in both opened and closed positions.

Still another object is to provide such a door opening apparatus which includes a selectively positionable shield plate for protecting personnel from possible injury during door opening and closing cycles.

These and other features and advantages of the invention will be more readily apparent upon reading the following description of a preferred exemplary embodiment of the invention and upon reference to the accompanying drawings wherein:

Figure 1:
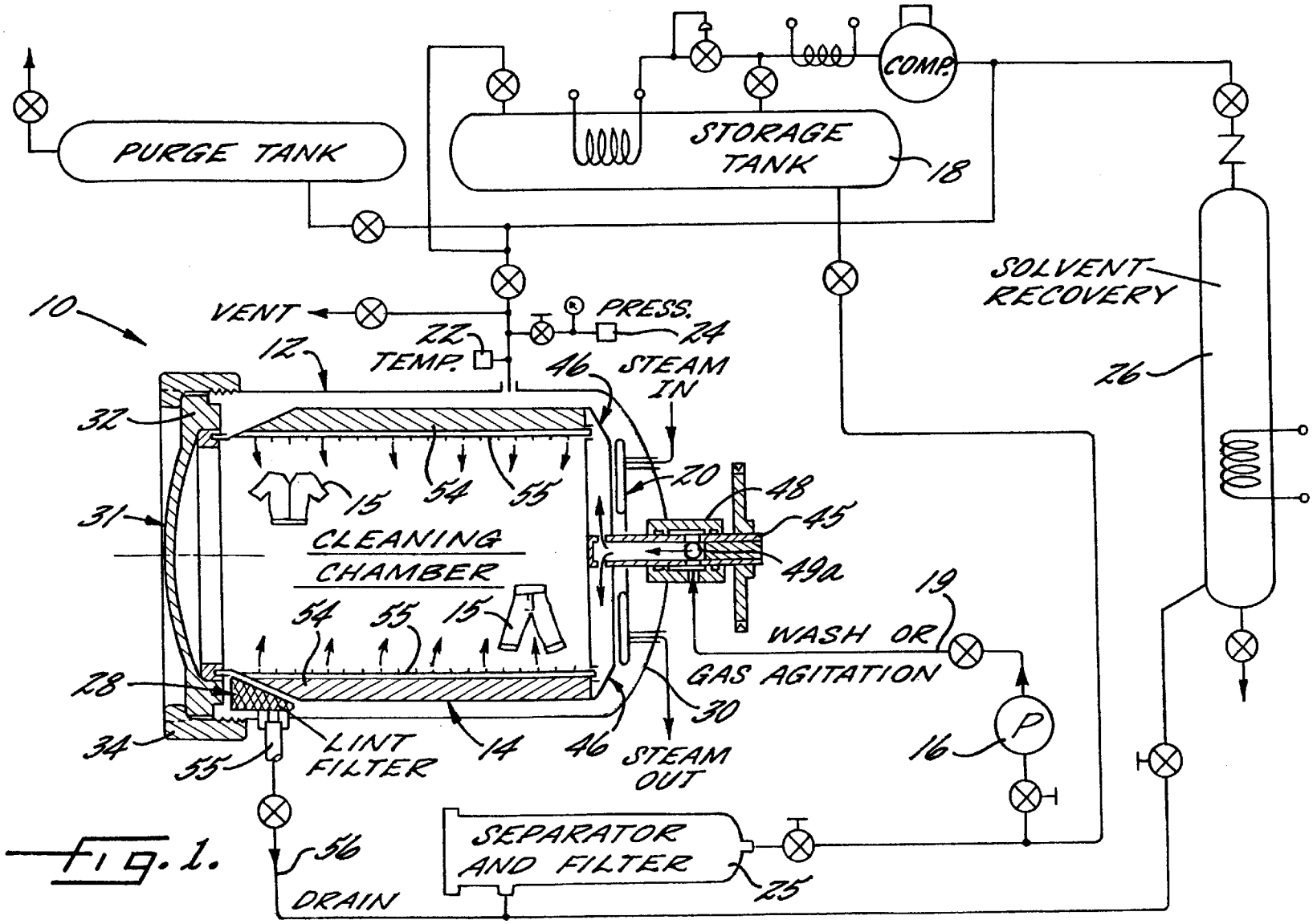
FIG. 1 is a schematic of an illustrative liquified gas dry cleaning machine having a cleaning vessel in accordance with the invention.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE DRAWINGS

Referring now more particularly to FIG. 1 of the drawings, there is shown a diagrammatic depiction of an illustrative liquified gas, dry-cleaning machine 10 embodying the present invention. In general, the dry-cleaning machine 10 includes a cleaning vessel 12 having a basket 14 rotatably disposed therein for containing items 15 to be cleaned. A liquid wash bath derived from a liquifiable gas, such as carbon dioxide, is used as the dry-cleaning solvent. A pump 16 is provided for directing the wash bath from a gas supply storage tank 18 and through an inlet line 19 into the pressure vessel 12. The vessel 12 is equipped with a steam heater 20, pressure sensor 21, and temperature sensor 22 to aid in temperature and pressure control for properly maintaining the wash bath in liquid phase during the dry-cleaning cycle.

The basic operation of a liquified gas dry-cleaning system is known in the art, as reflected by U.S. Pat. Nos. 5,651,276, 5,467,492, and 5,651,276, the disclosures of which are incorporated herein by reference. After the basket 14 is loaded with items, such as garments, for cleaning, the pump 16 charges the vessel 12 with a wash bath drawn from the storage tank 18, which functions as the cleaning solvent during a drying cycle. Upon completion of the dry cleaning cycle, the wash bath is drained from the cleaning vessel and remaining wash bath vapors evacuated and re-liquified by an appropriate condenser for return to the storage tank.

For separating contaminants from the wash bath liquid following a cleaning cycle, the wash bath is cycled through a filtration and separator system 25 which functions to filter and vaporize the wash bath, thereby concentrating the particulate matter and other contaminants. The gaseous vapor is re-liquified in a condenser 26 for return to the storage tank 18. The pressure vessel 12 in this instance includes an internal lint filter 28 for removing lint and course solids from the wash bath as it is drained from the pressure vessel, as disclosed in commonly assigned application Ser. No. 09/338,653, filed Jun. 23, 1999, the disclosure of which is incorporated herein by reference.

Figure 2:
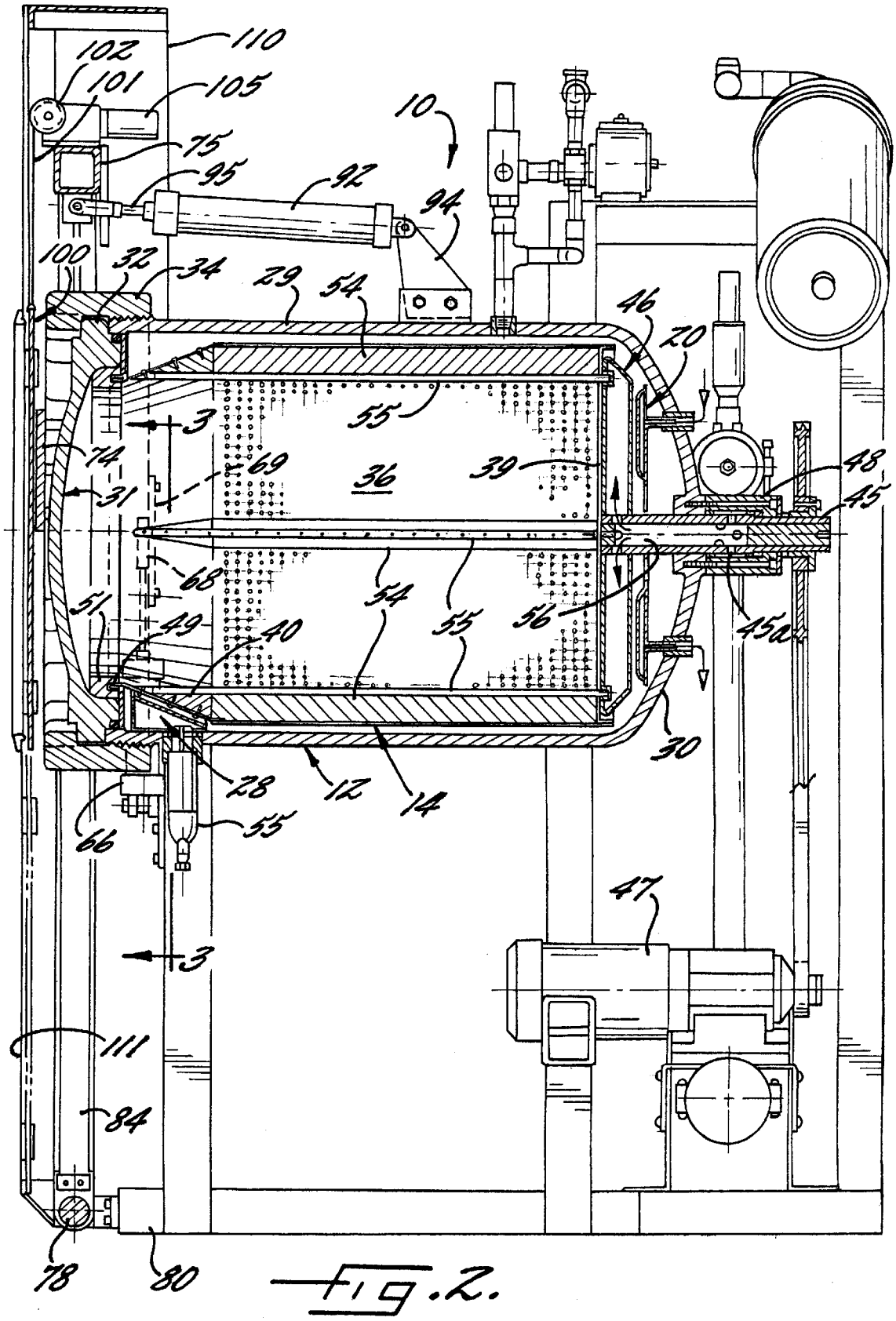
FIG. 2 is an enlarged longitudinal section of the liquified gas of dry cleaning machine shown in FIG. 1.
Figure 4:
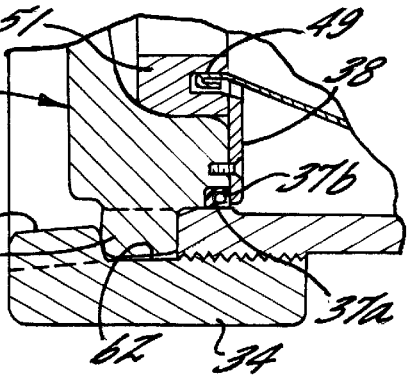
FIG. 4 is an enlarged fragmentary section taken in the plane of line 4—4 in FIG. 3*a;*

The illustrated cleaning vessel 12, as best depicted in FIG. 2 comprises an elongated housing 29 having a rounded end wall 30 integrally formed at one end and a removable door 31, also of generally rounded configuration, releasably secured at the other end. The housing 29 defines a cylindrical cleaning chamber within which the rotary basket 14 is disposed. The removable door 31 has an outer annular retaining flange 32 secured in abutting relation to the end of the housing 29 by means of a locking ring 34 threadedly engaging the end of the housing 29. An annular seal 37 is retained about the door by a retainer plate 38 which is screwed to the door and defines an innermost annular face of the door when in a closed position (FIG. 4). The annular seal 37 includes a C-shaped flexible member 37*a* opening toward the pressure vessel and annular spring 37*b* for maintaining opposed legs of the member 37*a* in sealing contact with the door and cleaning vessel during start up of the machine. As pressure increases within the cleaning chamber, the sealing legs of the C-shaped member 37*a* are urged into high pressure sealing engagement with the door and cleaning vessel.

The basket 14 for receiving and containing items to be cleaned is substantially coextensive in length with the housing 29 and has an outer cylindrical perforated sleeve 36 for enabling circulation of the liquid wash bath through the basket 14 during wash and rinse cycles. The perforated sleeve 36 is secured between a perforated back plate 39 and a front member 40 that defines a central inlet opening to the basket 14 when the door 31 is opened.

For supporting the basket 14 for rotating movement relative to the cleaning vessel 12, the basket 14 has an outwardly extending support and drive shaft 45 extending through the pressure vessel end wall 30 and a spider-configured trunion 46 fixed to the shaft 45 and back plate 39. The drive shaft 45, which preferably is reversibly driven by a bi-directional motor 47, is rotatably supported in an annular collar 48 affixed in outstanding relation to the end wall 30 of the cleaning vessel. For supporting the opposite end of the basket 14 for rotational movement when the door 31 is in a closed position, the front member 40 terminates in an annular ring 49 that is received and supported within a groove of an annular pilot plate 51 fixed within an annular recess of door 31 on the inner side thereof (FIG. 4).

For agitating items contained within the cleaning chamber and wash bath and for enhancing removal of solid particulate material from the items during a dry cleaning cycle, the basket 14 has a plurality of longitudinal mixing baffles 54, oriented parallel to the rotary axis of the basket, which each support a gas jet manifold 55 formed with a plurality of axially spaced, discharge orifices or nozzles 56, as disclosed in commonly assigned application Ser. No. 09/338,292 filed Jun. 23, 1999, disclosure of which also is incorporated herein by reference. Liquified gas is directed from the storage tank 18 through the collar 48 and communicates through radial apertures 49 in the drive shaft with a shaft passage 56, hollow legs of the trunion 46, and through the manifold tubes 55 for radial direction as pressurized jets or streams of liquified gas into the basket 14 simultaneously with rotation of the basket 14. Following the dry-cleaning cycle, the liquid wash bath is drained from the cleaning vessel 14 through a drain 55 mounted in the bottom of the pressure vessel housing 29 and directed to the filtration and separator system 25 via a return line 56.

Figure 3A:
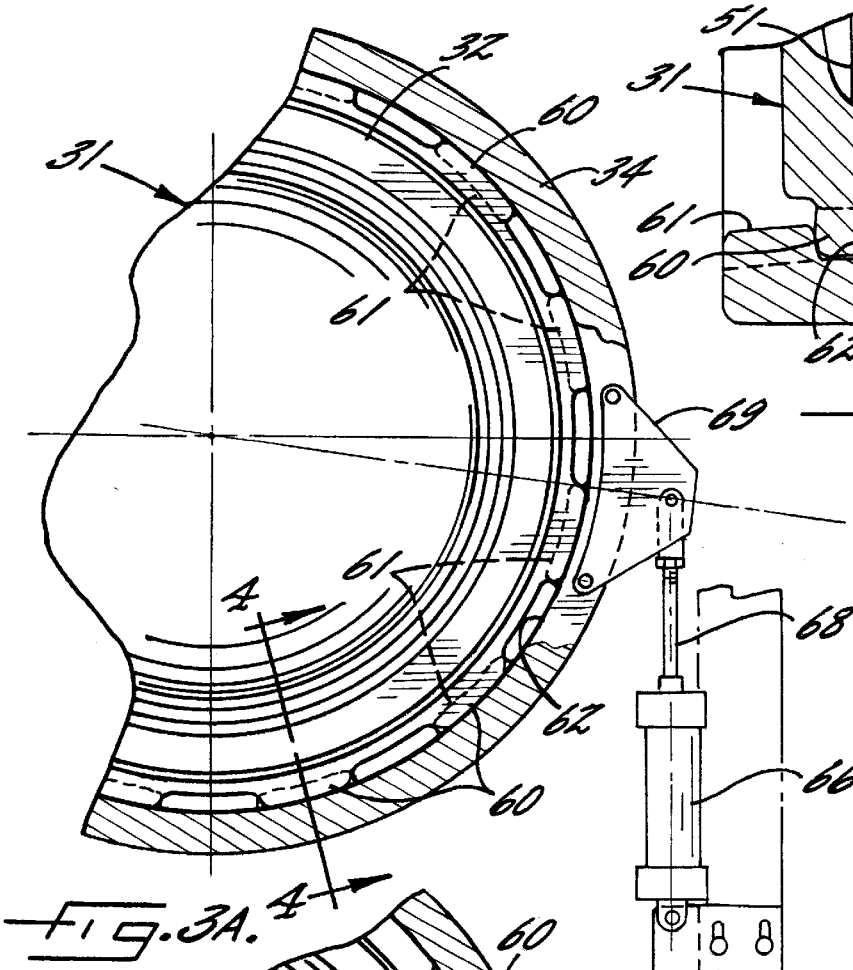
FIG. 3*a* is an enlarged vertical section taken in the plane of line 3—3 in FIG. 2, showing the cleaning vessel access door locking ring in a locked position.
Figure 3B:
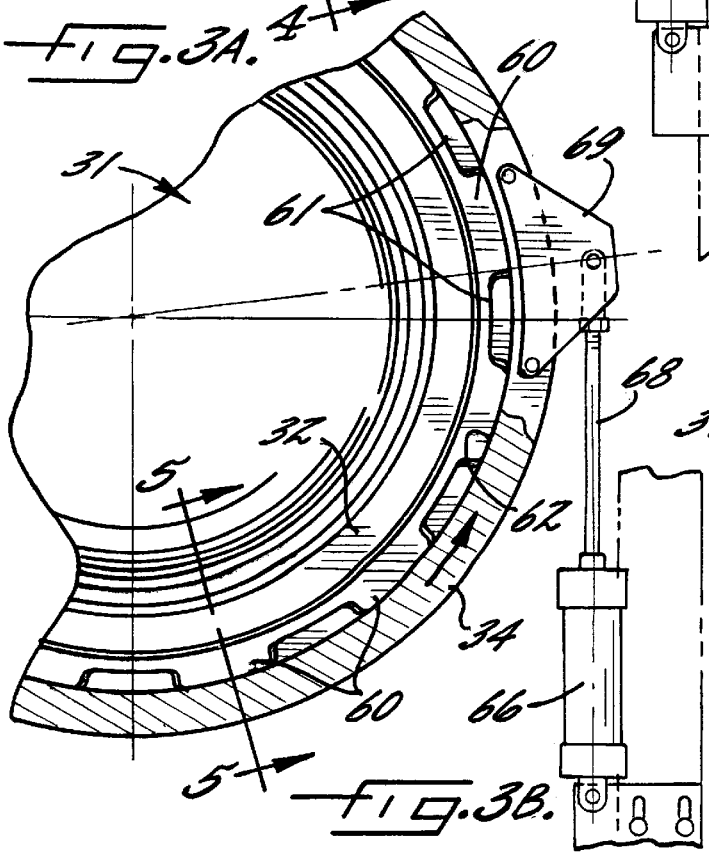
FIG. 3*b* is an enlarged fragmentary section, similar to FIG. 3*a*, but showing the door locking ring moved to an opening position.
Figure 5:
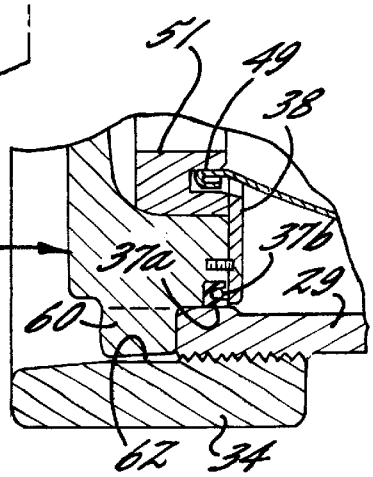
FIG. 5 is an enlarged fragmentary section taken in the plane of line 5—5 in FIG. 3*b;*
Figure 6:
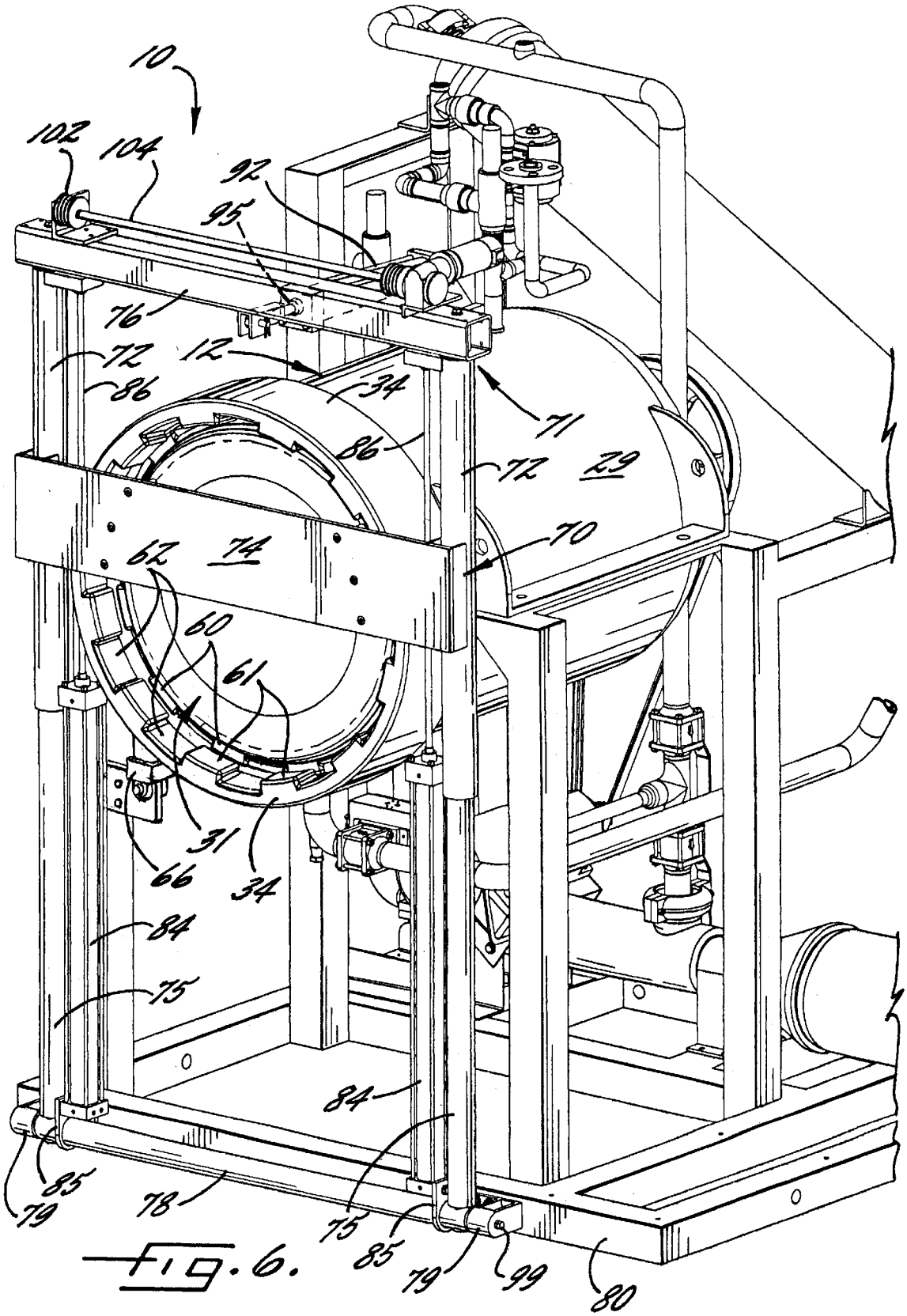
FIG. 6 is a perspective of the illustrative dry cleaning machine with the cleaning vessel door in a closed position, with outer decorative and enclosing panels of the machine removed for clarity.
Figure 7:
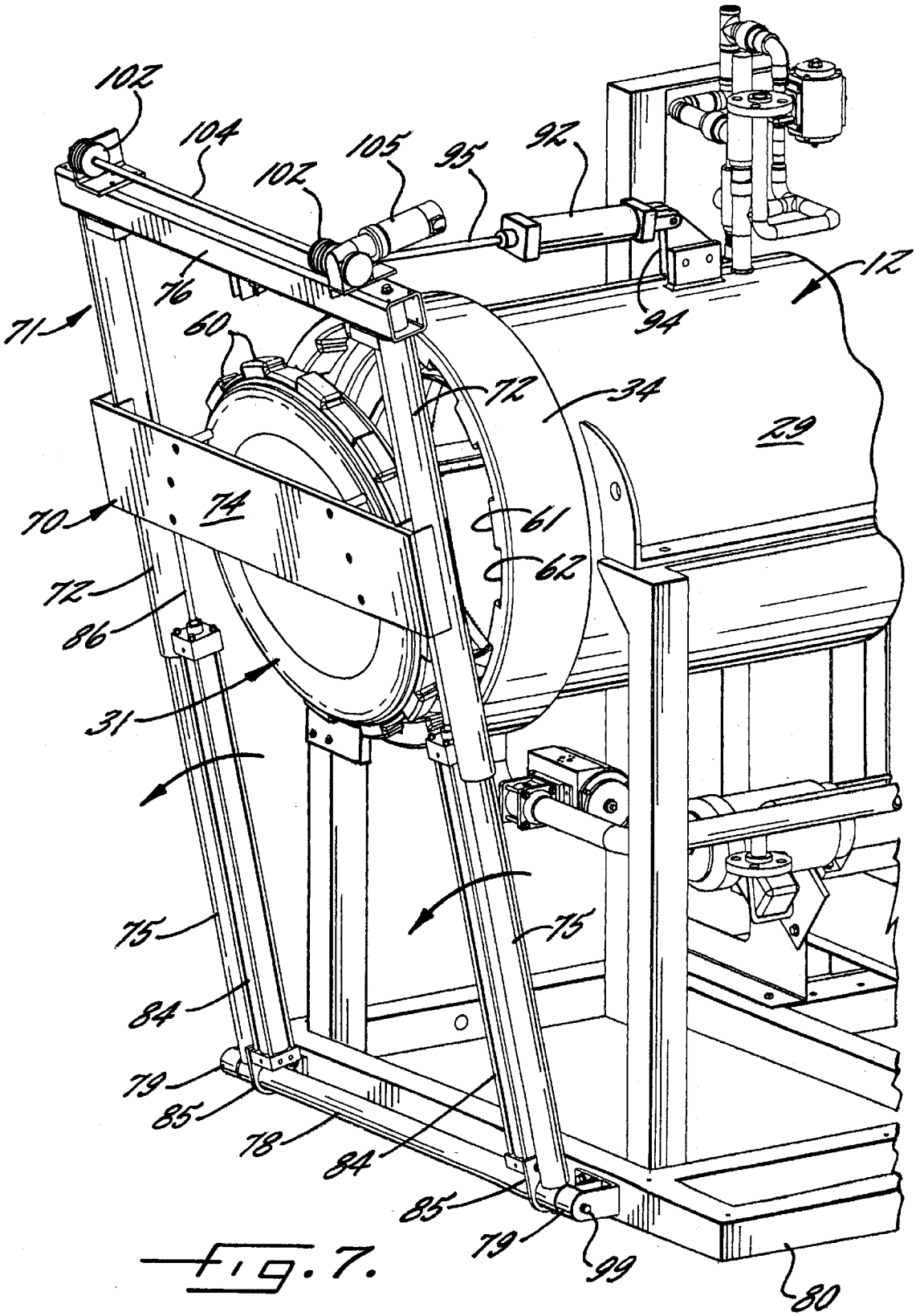
FIGS. 7–9 are perspectives, similar to FIG. 6, sequentially illustrating operation of the door opening apparatus.
Figure 8:
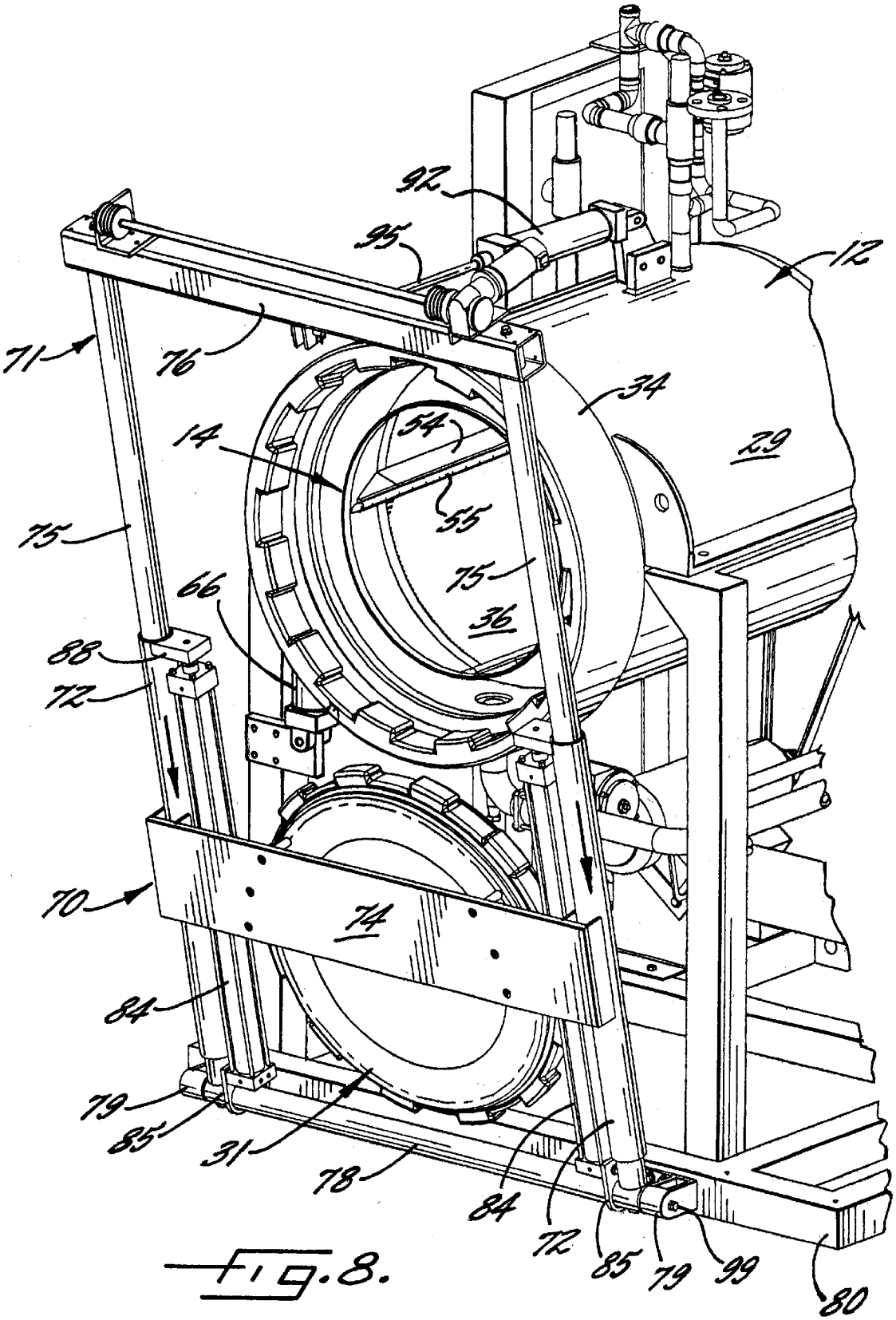
Figure 9:
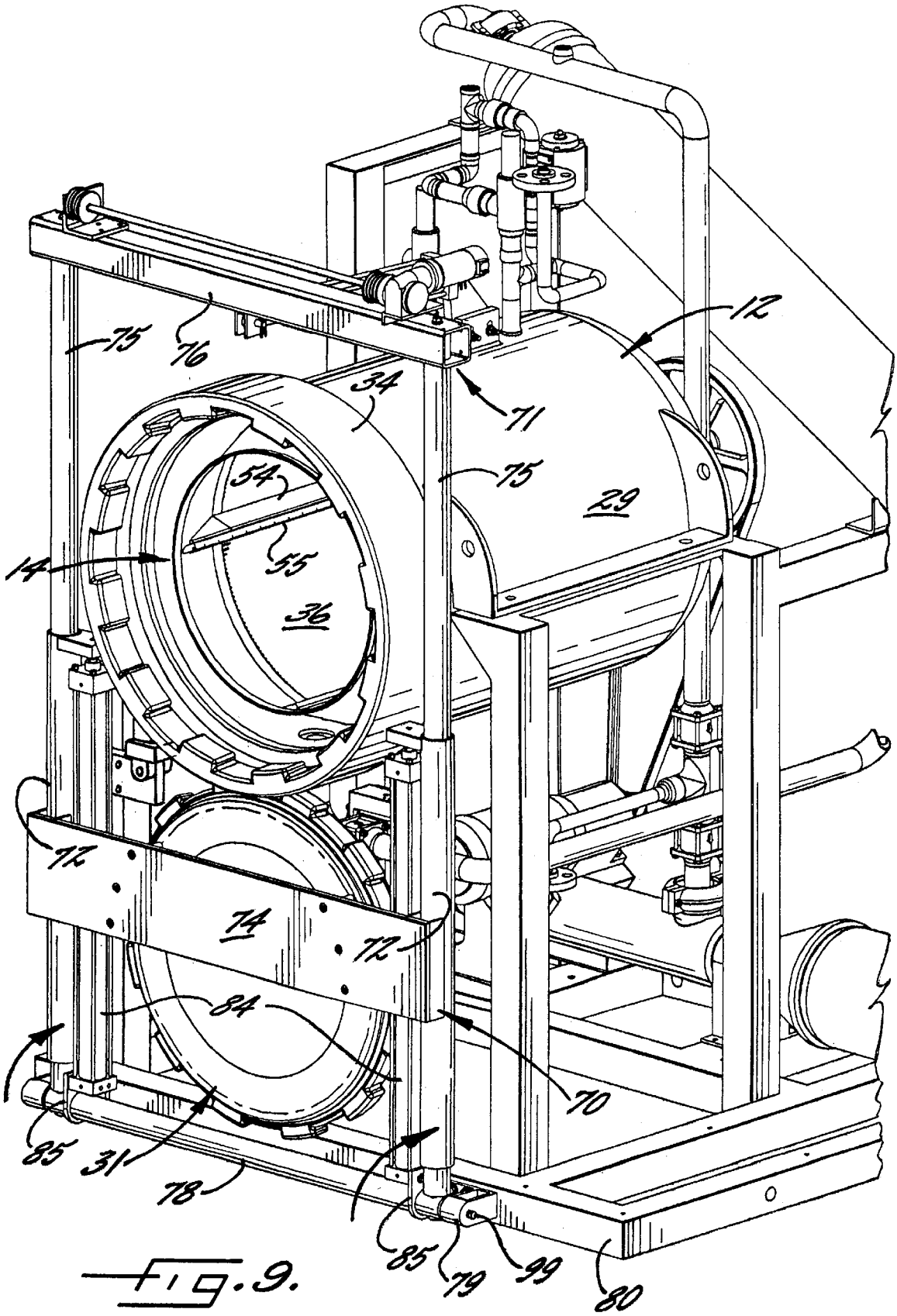
Figure 10:
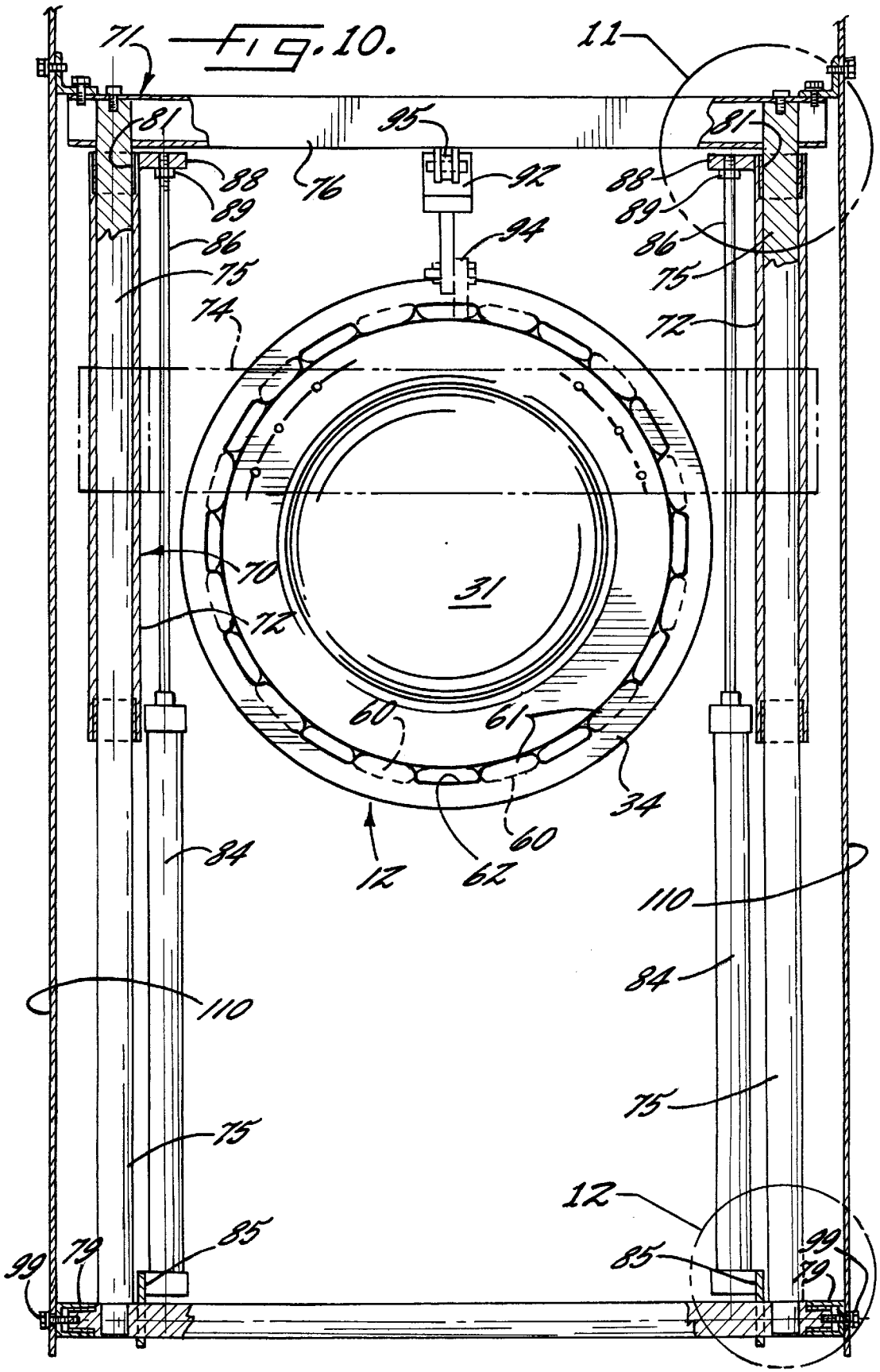
FIG. 10 is a front plan view, in partial section, of the illustrated door opening apparatus.
Figure 11:
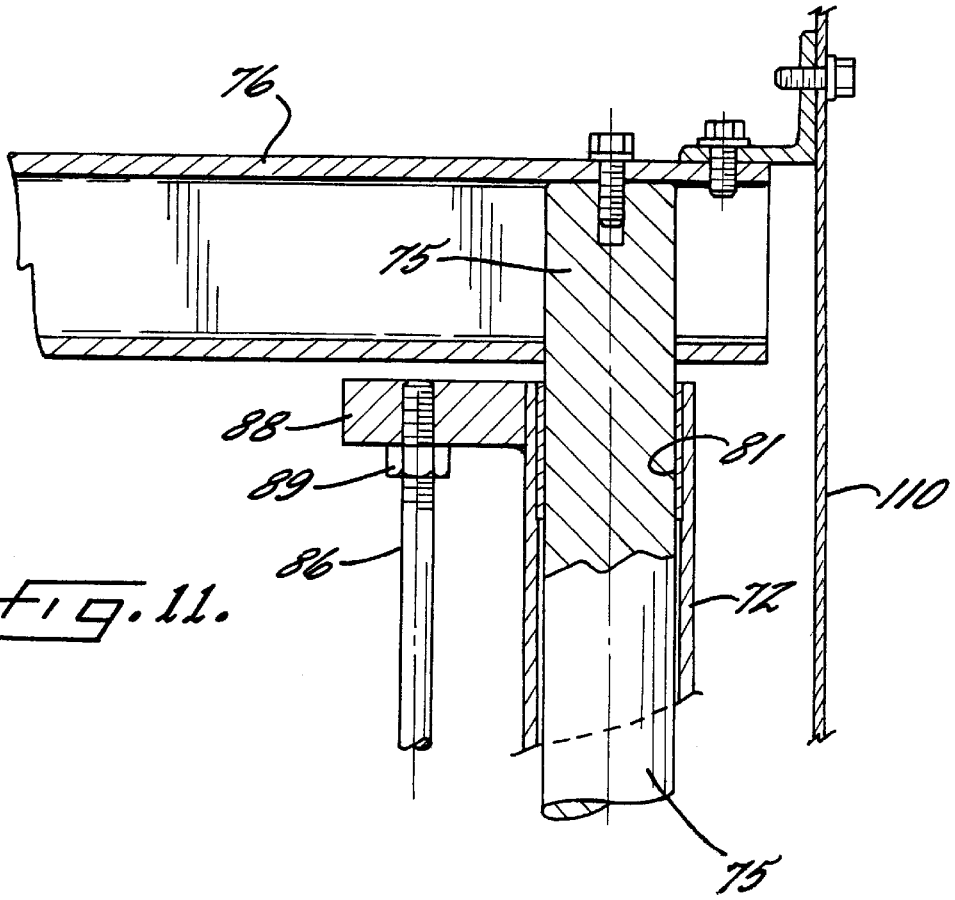
FIGS. 11 and 12 are enlarged fragmentary sections depicting the encircled areas references 11 and 12, respectively, in FIG. 10.
Figure 12:
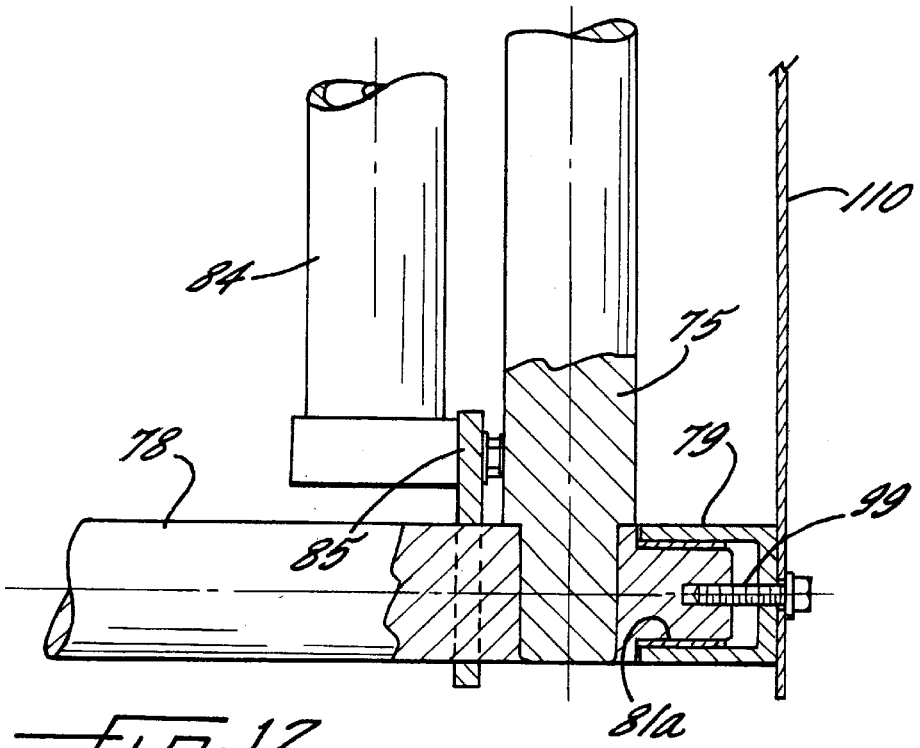
Figure 13:
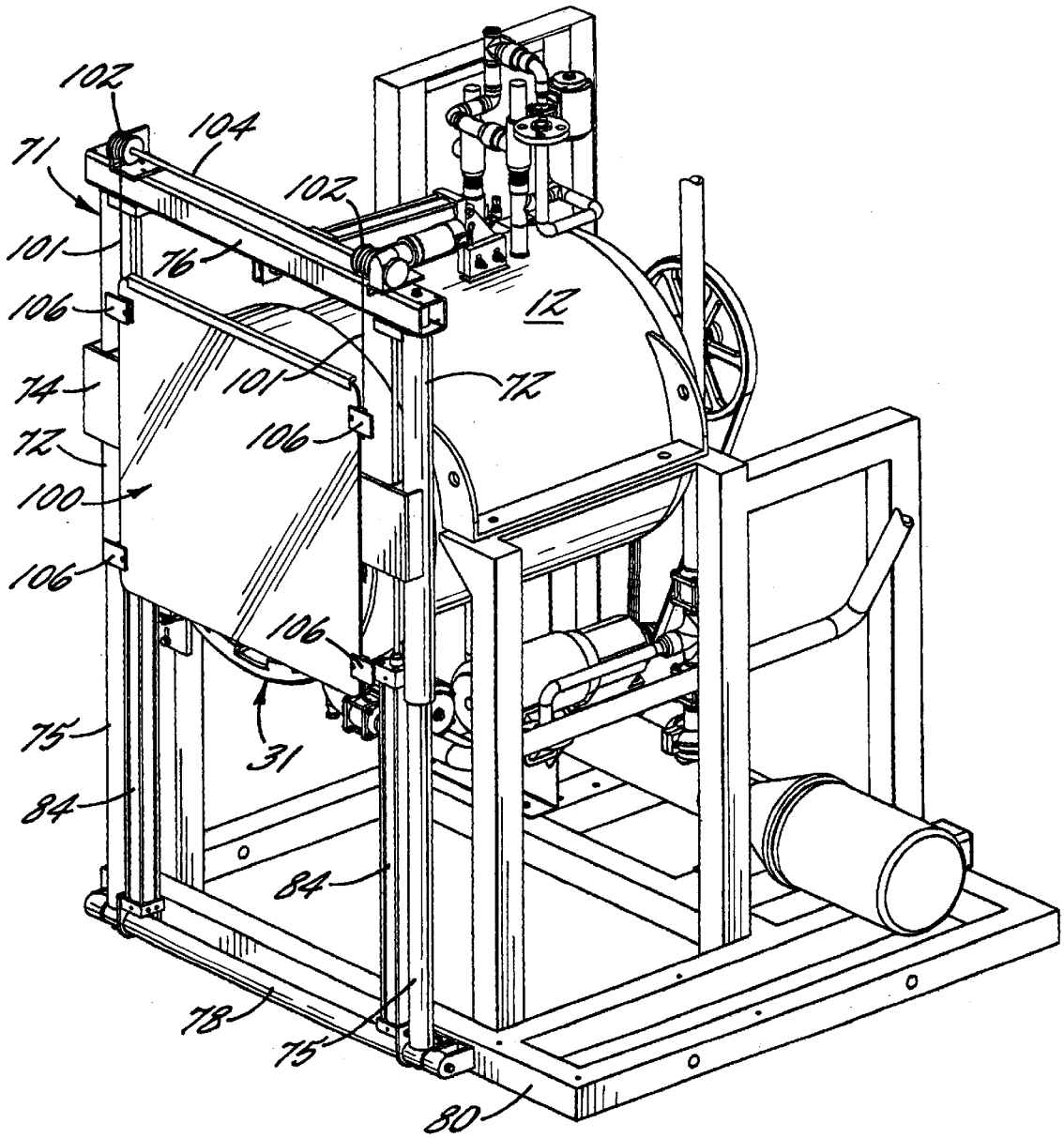
FIG. 13 is a perspective of the illustrative dry cleaning machine with a protective glass plate of the door opening apparatus shown in a raised protective position.
Figure 14:
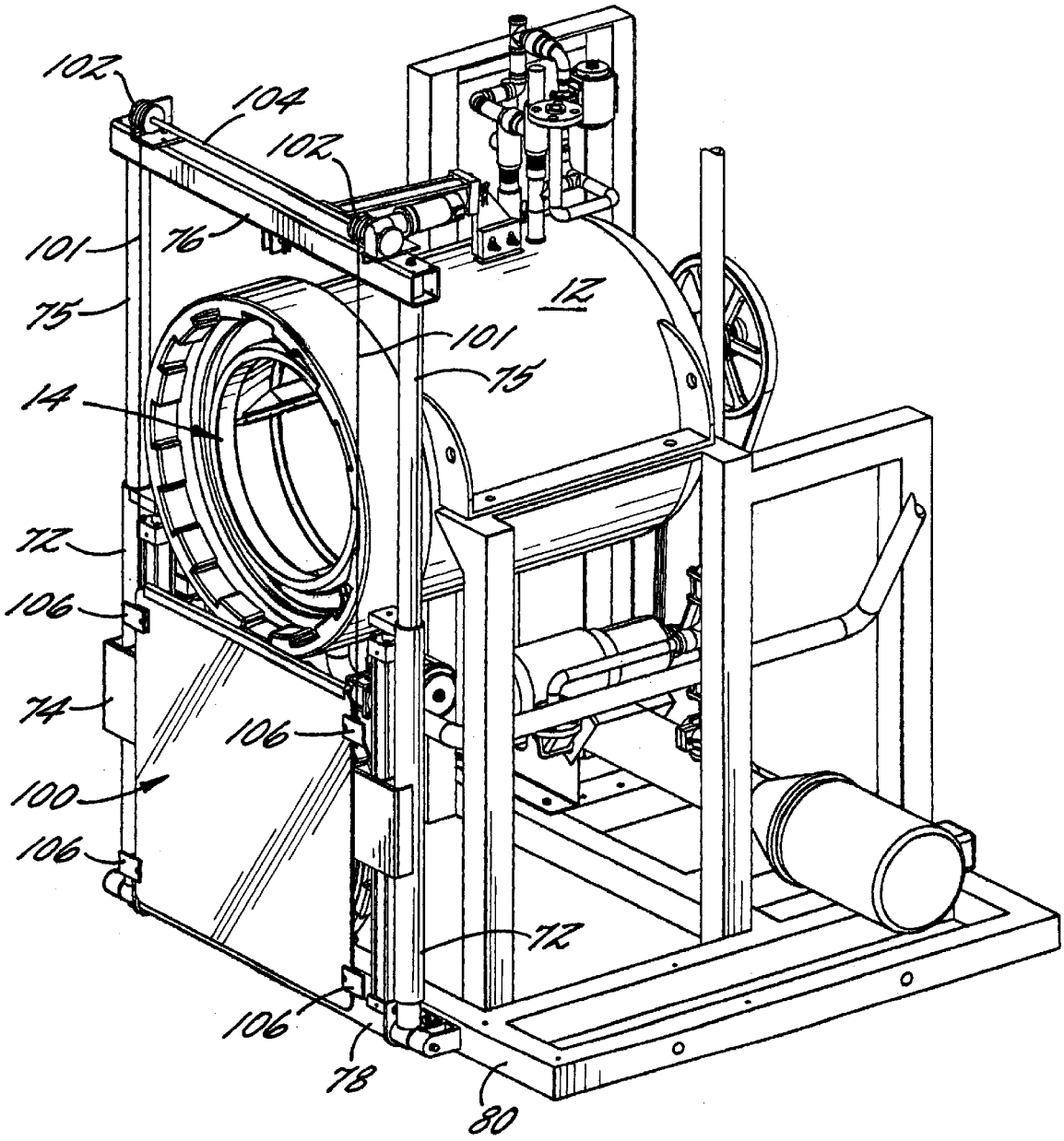
FIG. 14 is a perspective, similar to FIG. 13, showing the protective glass plate of the door opening apparatus in a lowered position.
Figure 15:
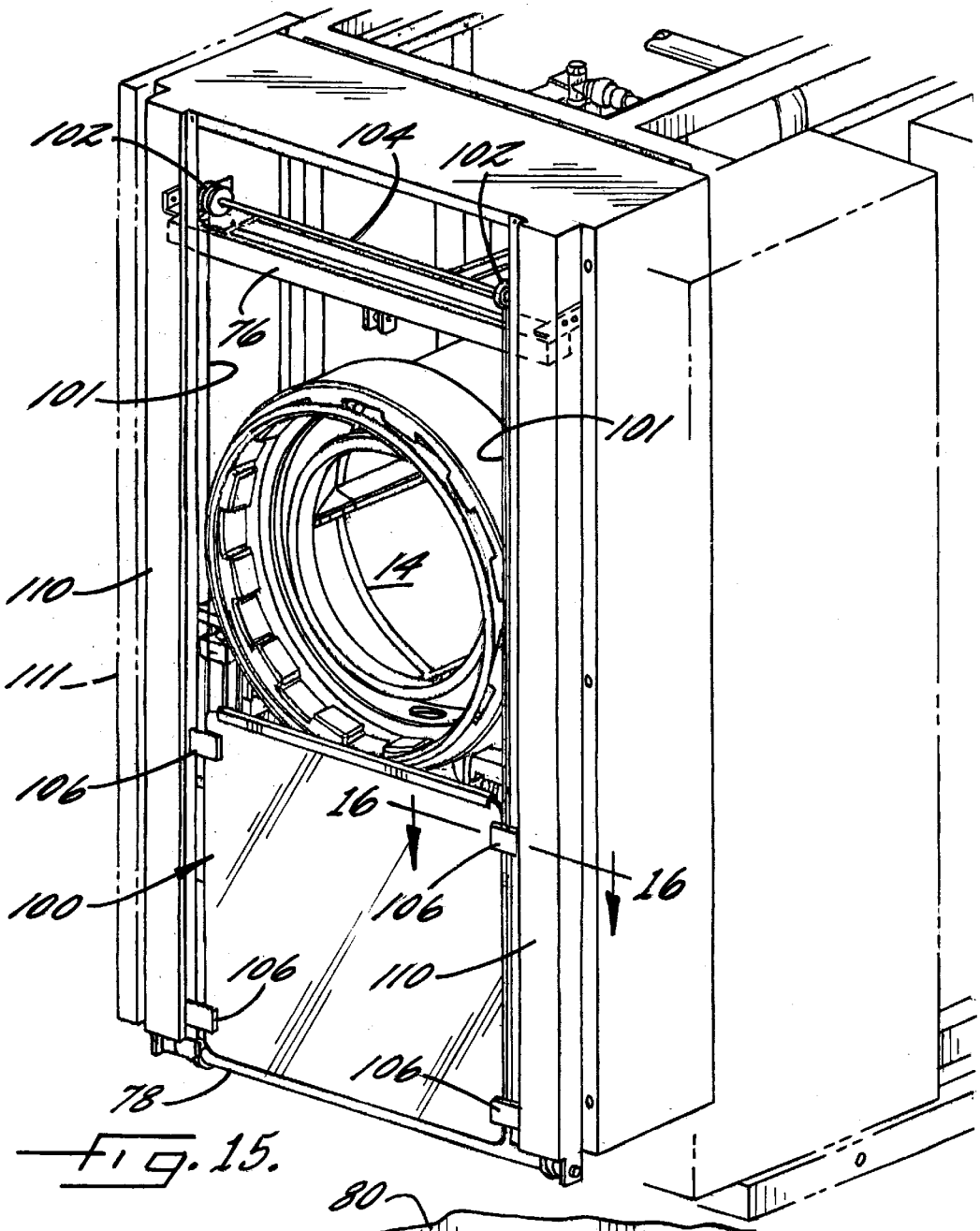
FIG. 15 is a perspective of the illustrative machine and door closure apparatus showing the enclosing paneling, and with the protective glass plate in a lowered position after the door has been opened.
Figure 16:
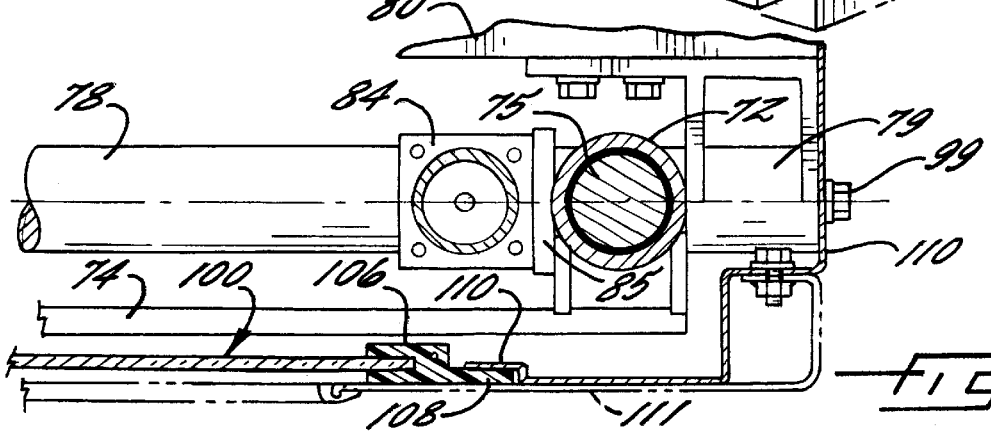
FIG. 16 is an enlarged fragmentary section, taken in the plane of line 16—16 in FIG. 15.

In order to unlock the door 31 and enable it to be opened following a dry-cleaning cycle, the locking ring 34 is rotatable between locking and unlocked positions (FIGS. 3A and 3B). The door 31 in this instance has a plurality of circumferentially spaced, radially extending locking lugs 60 about its periphery, and the locking ring 34 has a plurality of similarly spaced inwardly extending locking lugs 61 about its periphery which define grooves or recesses 62 which enable passage of the door locking lugs 60 axially inwardly beyond the locking ring lugs 61 as the door is moved to a closed position against the end of the cleaning vessel 12 (FIGS. 3A, 3B, 4 and 5). The locking ring 34 is then rotatable a small angle for moving the locking ring lugs 61 in juxtaposed relation to the door lugs 60 for retaining the door 31 in mounted position. It will be appreciated that by virtue of the threaded engagement of the locking ring 34 on the cleaning vessel 12, such small rotational movement of the locking ring 34 will axially advance the locking ring 34 a small distance on the cleaning vessel, and reverse rotation of the locking ring 34 will retract the locking ring a similar small distance. For selectively rotating the locking ring 34 between locked and unlocked positions, a double actuating pneumatic cylinder 66 is affixed at one end to a frame of the dry cleaning machine 10 with its piston rod 68 coupled to a bracket 69 fixed to the locking ring 34, as depicted in FIG. 3A.

With the locking ring 34 rotated to an unlocked position following completion of a dry-cleaning cycle, the door 31 may be removed from the cleaning vessel 12 to permit access and removal of the cleaned items within the cleaning chamber. As indicated previously, due to the bulk and size of the door 31, heretofore mechanisms for opening the door have been complicated and have utilized considerable space about the cleaning vessel. Moreover, depending upon the design of the door opening mechanism, either the mechanism or the removed door may impede access to the cleaning chamber and/or increase the axial reach necessary for an operator to manually reach into the cleaning vessel to unload the cleaned items.

In accordance with the present invention, the cleaning vessel is equipped with an apparatus for opening and closing the door which requires minimal clearance space for operation and which does not impede access to the cleaning chamber for removal of items following a dry cleaning cycle. More particularly, the door opening apparatus is operable for maintaining the door entirely within the lateral confines of the cleaning vessel during opening and closing cycles, and both the door and the door opening apparatus assume a common axial position relative to the cleaning vessel in both opened and closed positions so as not to increase the axial reach necessary for an operator to manually remove items from the cleaning chamber. To this end, in the illustrated embodiment the door 31 is mounted on a vertically movable slide 70, which in turn is mounted on a pivot frame 71, the combined movements of which are effective for removing the door from the cleaning vessel 12 and positioning the door under the cleaning vessel at an axial location identical to that of the door when in a closed position on the cleaning vessel.

The door carrying slide 70 in this instance comprises a pair of side sleeves 72 and a cross brace 74 fixed between the side tubes 72 intermediate their ends. The cleaning vessel door 31 is secured to the cross brace on a side thereof facing the cleaning vessel 12. The pivot frame 71 comprises a pair of vertical posts 75 fixed at their upper ends by an upper cross brace beam 76, as depicted in FIGS. 7 and 10–12 The lower ends of the support posts 75 are fixed within a lower pivot shaft 78 which in turn is mounted for relative rotational movement within a bearing bracket 79 fixed to a frame 80 of the machine. The sleeves 72 of the door carrying slide 70 are mounted on the posts 75 for relative sliding movement. Teflon sleeve bushings 81 are fixed within the sleeves 72 to facilitate relative movement.

For selectively moving the slide 70 between raised and lowered positions on the support shafts 75, double actuating pneumatic air cylinders 84 are mounted in adjacent relation to the support shafts 75. The illustrated cylinders 84 are fixed at their lower end to the pivot shaft 78 by a mounting bracket 85 and the cylinder rods 86 thereof each are in threaded engagement with a flange 88 fixed in lateral extending relation to the upper end of the respective sleeve 72. A jam nut 89 secures the cylinder rod 86 in fixed relation to the bracket 88. By appropriate actuation of the cylinders 84, the rods 86 can be extended or retracted to raise and lower the slide 70 and the door 31 mounted thereon between raised and lowered positions. To selectively pivot the pivot frame 71 and the door carrying slide 70 mounted thereon relative to the end of the cleaning vessel 12, a double actuating pneumatic cylinder 92 is fixed at one end to the pressure vessel 12 by a mounting bracket 94 with its piston rod 95 secured to the upper brace 76 of the pivot frame 71.

To accommodate pivotal movement of the door 31 into and out of the locking ring 34 during door opening and closing cycles and to minimize stress concentrations on the locking lugs 60, 61 of the door and rings 31, 34, respectively, the lugs 60, 61 preferably are tapered and have a geometry such as disclosed in United States application Ser. No. 09/338,591, filed Jun. 23, 1999, the disclosure of which is incorporated herein by reference. To further enable precise aligned assembly of the door 31 on the pressure vessel 12, the tilt frame 71 has a lateral adjustment feature which includes alignment bolts 99 threaded into blind holes in the end of the bearing bracket 79 in abutting relation to the ends of the pivot shaft 78. Adjustment of the bolts 99 enables the pivot shaft 78 and hence the door carrying frame 71, to be positioned such that it is located in relatively precise alignment with respect to the cleaning vessel.

Operation of the door opening apparatus following completion of a dry-cleaning cycle is as follows. The locking ring cylinder 66 is actuated to rotate the locking ring 34 from a locked position (FIG. 3A) to an unlocked position (FIG. 3B), in which the recesses 62 in the locking ring 34 are aligned with the lugs 60 in the door 34. Actuation of the pivot frame cylinder 97 extends the cylinder rod 94 and pivots the pivot frame 71 and the door carrying slide 70 mounted therein, moving the door 34 outwardly with respect to the locking ring 34 and cleaning vessel 12 such that the door locking lugs 60 clear the locking ring 34. Actuation of the slide cylinders 84 retracts the cylinder rods 86 thereof and lowers the door carrying slide 70 to a lowered position with the door 34 disposed below the cleaning vessel 12. The reverse actuation of the pivot frame cylinder 92 returns the pivot frame to its upright position, moving the door 34 into a tucked position below the locking ring 34.

It will be appreciated by one skilled in the art that as the door 31 is moved between its closed and opened positions, it is maintained entirely within the lateral confines of the pressure vessel 12. Moreover, the apparatus requires minimal axial clearance for operation, namely an axial distance only slightly greater than that necessary for removing the door 31 from the locking ring 34. Lowering of the door slide 70 on the pivot frame 71 through actuation of the cylinders 84 and pivotal movement of the pivot frame 71 through reverse actuation of the cylinders 92, returns the door 31 to an identical axial location relative to the pressure vessel 12 as when in the closed position. Hence, neither the opened door nor the operating apparatus impede access to the cleaning chamber, nor increase the axial reach necessary for an operator to manually remove cleaned items from the cleaning vessel.

In carrying out the invention, the tilt frame 71 has a selectively positionable protective plate 100, preferably made of tempered glass, that is positionable directly in front of the pressure vessel during door opening and closing cycles in order to protect personnel in the surrounding area from possible injury as a result of movement of the door and its operating mechanism. The protective plate 100 is supported from a top side by a pair of cables 101, which each are suspended from a respective capstan 102 mounted on a common drive shaft 104 supported immediately above the pivot frame cross brace 76. The capstan drive shaft 102 is rotatably driven through a gear reducer and bi-directional drive motor 105.

For guiding movement of the protective glass plate 100 between raised and lowered positions, the glass plate 100 has brackets 106 fixed on opposite sides thereof, each having a laterally extending guide flange 108 received within a guide track defined between side panels 110 of the pivot frame 71 and a front cover panel 111. The panels 110, 111 are secured to the pivot frame 71 and enclose the respective sides of the tilt frame and operating mechanisms.

At the beginning of a door opening cycle and prior to unlocking of the locking ring 34 through actuation of the cylinder 66, the motor 105 is actuated to raise the glass plate 100 to its upper position which protectively shields the door and locking ring. The door opening cycle is then is carried out with the glass plate remaining in the raised position on the tilt frame 71 throughout. After the door 31 has been removed from the cleaning vessel, lowered, and located in its tucked position below the locking ring 31, the motor 105 is reversely driven to allow the door to return to its lowered position so as to enable access to the cleaning chamber for removal of cleaned items therein. Similarly, prior to a door closing cycle, the protective glass plate 100 is lifted to its raised position adjacent the front side of the pressure vessel and remains there until the door 31 is returned completely to a locked position on the pressure vessel 12.

From the foregoing, it can be seen that the dry-cleaning vessel door opening apparatus of the present invention satisfies the needs that have existed in the prior art. The apparatus occupies and operates within minimal clearance space in front of the cleaning vessel, while storing the removed door in a tucked position below the cleaning vessel so as neither to impede access to the cleaning vessel nor increase the required axial reach of an operator during loading and unloading of items from the cleaning vessel. The apparatus further protectively shields the operator from inadvertent injury during the door opening and closing cycles.

What is claimed is:

1. A dry-cleaning machine comprising a cleaning vessel having a chamber for containing a wash bath and items to be cleaned, said cleaning vessel having a door that is movable between an open position for enabling items to be loaded into said cleaning vessel chamber and a closed position sealing said cleaning vessel chamber, a cleaning liquid supply operable for selectively directing a cleaning liquid into said cleaning vessel chamber when said door is closed for use during a cleaning cycle, and a door opening and closing apparatus operable at the end of a cleaning cycle for moving the door outwardly away from the cleaning vessel and lowering the door to a stored position below the elevation of the cleaning vessel without movement beyond the lateral confines of the cleaning vessel.

2. The dry-cleaning machine of claim 1 in which said door opening and closing apparatus includes a pivot frame mounted for pivotal movement with respect to said cleaning vessel, a slide mounted for movement with said pivot frame and for reciprocating movement relative to said pivot frame, and said door being mounted on said slide.

3. The dry-cleaning machine of claim 2 in which said pivot frame is pivoted between an upright position with said slide in a raised position and said door in said closed position and an outer position in which said slide and door move in an arc path away from said cleaning vessel.

4. The dry-cleaning machine of claim 3 in which said slide and door are movable to a lowered position below the elevation of said cleaning vessel when said pivot frame is in said outer position, and said pivot frame is movable from said outer position to said upright position with said slide in said lowered position to locate said door under the forward end of said cleaning vessel at an identical axial location relative to the cleaning vessel as when in said closed position.

5. The dry-cleaning machine of claim 4 including a first actuator for moving said door pivot frame between said upright position and said outer position, and a second actuator for moving said slide and door mounted thereon between a raised position and said lowered position.

6. The dry-cleaning machine of claim 2 in which said slide comprises a pair of laterally spaced sleeves interconnected by at least one cross brace, and said door being mounted on said cross brace.

7. The dry-cleaning machine of claim 6 in which said pivot frame comprises a pair of laterally spaced support posts interconnected by at least one cross brace, said posts being mounted for pivotal movement relative to said cleaning vessel, and said slide sleeves being mounted on said pivot frame posts for relative sliding movement.

8. The dry-cleaning machine of claim 7 including a machine frame, said pivot frame support posts being mounted on a pivot shaft, and bushings fixed to said frame for supporting said pivot shaft for relative rotational movement with respect to said machine frame.

9. The dry-cleaning machine of claim 8 including a pivot frame adjustment device for axially moving said pivot shaft, pivot frame, slide and door laterally relative to said cleaning vessel for selectively locating said door in aligned relation to said cleaning vessel.

10. The dry-cleaning machine of claim 9 in which said pivot frame adjustment device includes an adjusting bolt for engagement with an axial end of said pivot shaft whereby rotational movement of said adjusting bolt will laterally adjust the position of said pivot shaft.

11. The dry-cleaning machine of claim 1 including a locking ring mounted on said cleaning vessel for retaining the door in closed position, and an actuator for rotating said locking ring between a locked position in which said door is retained in closed position and an unlocked position in which said door closing and opening apparatus may move said door away from said cleaning vessel.

12. The dry-cleaning machine of claim 11 in which said locking ring is mounted in threaded engagement with a forward end of said cleaning vessel.

13. The dry-cleaning machine of claim 11 in which said locking ring and door each are formed with respective locking lugs, said locking ring and door lugs being in aligned juxtaposed relation to each other for preventing movement of said door from said closed position when said ring is in said locked position and said locking ring and door lugs being in offset relation to each other for permitting removal of said door from said closed position when said locking ring is in said unlocked position.

14. The dry-cleaning machine of claim 1 including a basket rotatably supported within said cleaning vessel for containing items during cleaning, said basket having a forward ring portion that defines an entry opening to said basket, and said door having an annular recess for receiving said forward ring portion and rotatably supporting said forward end of said basket when said door is in a closed position.

15. A dry-cleaning machine comprising a cleaning vessel having a cylindrical chamber for containing a wash bath and items to be cleaned, said cleaning vessel having a removable door, a door opening and closing apparatus for moving said door between an opened position for enabling items to be loaded into said cleaning vessel chamber and a closed position sealing said cleaning vessel chamber, a cleaning liquid supply for selectively directing a cleaning liquid into said cleaning vessel chamber when said door is closed for use during a cleaning cycle, said door opening and closing apparatus being sequentially operated to open said door by moving said door along a first non-axial path of movement with respect to the axis of said cylindrical pressure vessel chamber outwardly away from said cleaning vessel and then a second path of movement different from said first path which lowers the door to a level below said cleaning vessel.

16. The dry-cleaning machine of claim 15 including a first mechanism operable for moving said door along said first path, and a second mechanism operable for moving said door along said second path.

17. The dry-cleaning machine of claim 16 in which said first mechanism is operable for moving said door in an arced path of movement, and said second mechanism is operable for moving said door in a linear path.

18. The dry-cleaning machine of claim 17 in which said first mechanism is a pivot frame mounted for pivotal movement between a first position in which said door is in a closed position and a second position in which said door is removed outwardly from a forward end of said cleaning vessel, and said second mechanism includes a slide upon which said door is mounted, said slide and door being movable relative to said pivot frame between a raised position in adjacent spaced relation to a forward end of said cleaning vessel and a lowered position below the level of said cleaning vessel.

19. The dry-cleaning machine of claim 17 including a first actuator for moving said pivot frame between said first and second pivot frame positions, and a second actuator for moving said slide and door mounted thereon between raised and lowered positions.

20. The dry-cleaning machine of claim 19 including a locking ring mounted on said cleaning vessel for retaining the door in closed position, and a third actuator for rotating said locking ring between a locked position in which said door is retained in closed position and an unlocked position in which said door closing and opening apparatus may move said door away from said cleaning vessel.

21. The dry-cleaning machine of claim 17 in which said slide comprises a pair of laterally spaced sleeves interconnected by at least one cross brace, said door being mounted on said cross brace; said pivot frame comprising a pair of laterally spaced support posts interconnected by at least one cross brace, said posts being mounted for pivotal movement relative to said cleaning vessel, and said slide sleeves being mounted on said pivot frame posts for relative sliding movement

22. A dry-cleaning machine comprising a cleaning vessel having a chamber for containing a wash bath and items to be cleaned, said cleaning vessel having a removable door for closing a forward end of said cleaning vessel chamber, a cleaning liquid supply for selectively directing a cleaning liquid into said cleaning vessel chamber when said door is closed for use during a cleaning cycle, a door opening and closing apparatus for moving said door between a closed position against the forward end of said cleaning vessel and an opened position for enabling items to be loaded and unloaded from said cleaning vessel chamber, and a protective shield mounted on said door opening and closing apparatus for movement between a position adjacent the forward end of said cleaning vessel outwardly of said door during operation of the door opening and closing apparatus, and said protective plate being movable to a removed position away from the forward end of said cleaning vessel following completion of a door opening operation to permit access to items contained within the cleaning vessel.

23. The dry-cleaning machine of claim 22 in which said protective plate is made of tempered glass.

24. The dry-cleaning machine of claim 22 in which said door opening and closing apparatus includes a frame, and said protective plate is suspended from said frame by cables for movement relative to said frame.

25. The dry-cleaning machine of claim 24 in which said cables are suspended by respective capstans mounted on said frame, and a motor for rotating said capstans to draw in and let out said cables for raising and lowering said protective plate relative to said frame and said cleaning vessel.

26. The dry-cleaning machine of claim 24 in which said frame defines guide tracks for receiving lateral sides of said protective plate and guiding movement thereof.

27. The dry-cleaning machine of claim 24 in which said door is mounted on said frame, and said frame is mounted for pivotal movement for moving said door from said closed position to a position outwardly away from a forward end of said cleaning vessel.

* * * * *